US008309869B2

(12) United States Patent
Nagasaka et al.

(10) Patent No.: US 8,309,869 B2
(45) Date of Patent: Nov. 13, 2012

(54) ROTATING OPERATION MEMBER FOR A SWITCH

(75) Inventors: Hidenori Nagasaka, Anjo (JP); Akira Tomonaga, Anjo (JP); Junichi Nishikimi, Anjo (JP); Tatsuya Yoshizaki, Anjo (JP)

(73) Assignee: Makita Corporation, Anjo-Shi (JP)

( * ) Notice: Subject to any disclaimer, the term of this patent is extended or adjusted under 35 U.S.C. 154(b) by 337 days.

(21) Appl. No.: 12/850,037

(22) Filed: Aug. 4, 2010

(65) Prior Publication Data

US 2011/0031098 A1 Feb. 10, 2011

(30) Foreign Application Priority Data

Aug. 6, 2009 (JP) ..... 2009-183426

(51) Int. Cl.
*H01H 3/08* (2006.01)

(52) U.S. Cl. ..... 200/336

(58) Field of Classification Search ..... 200/336, 200/567, 61.27; 310/47, 50
See application file for complete search history.

(56) References Cited

U.S. PATENT DOCUMENTS 4,733,034 A * 3/1988 Armstrong et al. ..... 200/564
4,772,765 A * 9/1988 Markle et al. ..... 200/1 V
5,047,600 A * 9/1991 Enari et al. ..... 200/61.54
5,089,729 A * 2/1992 Moores, Jr. ..... 310/50
5,170,851 A * 12/1992 Kress et al. ..... 173/29
6,269,888 B1 * 8/2001 Schuda et al. ..... 173/48
8,193,458 B2 * 6/2012 Hozumi et al. ..... 200/1 V
2002/0144885 A1 * 10/2002 Ushimaru ..... 200/336

FOREIGN PATENT DOCUMENTS

DE 41 28 651 A1 3/1993
JP A-2007-283471 11/2007

OTHER PUBLICATIONS

Partial European Search Report for corresponding European Patent Application No. 10008182.7, mailed on Apr. 20, 2011.

* cited by examiner

*Primary Examiner* — Vanessa Girardi
(74) *Attorney, Agent, or Firm* — Oliff & Berridge, PLC

(57) ABSTRACT

A switch device includes a switch body and an operation member. The switch body includes a case and a rotary shaft rotatably supported by the case and extending from one end of the case in an axial direction. The operation member is joined to the rotary shaft. The case has a cylindrical outer surface and the operation member has a cylindrical inner surface disposed coaxial with the cylindrical outer surface of the case. A support member is disposed at one of the cylindrical outer surface of the case and the cylindrical inner surface of the operation member and has an edge portion extending linearly along a circumferential direction of the one of the cylindrical outer surface and the cylindrical inner surface, so that the edge portion can slidably contact the other of the cylindrical outer surface of the case and the cylindrical inner surface of the operation member.

14 Claims, 4 Drawing Sheets

ROTATING OPERATION MEMBER FOR A SWITCH

This application claims priority to Japanese patent application serial number 2009-183426, the contents of which are incorporated herein by reference.

BACKGROUND OP THE INVENTION

1. Field of the Invention

The present invention relates to switch devices.

2. Description of the Related Art

Japanese Laid-Open Patent Publication No. 2007-283471 discloses a known switch used for an impact screwdriver having a rechargeable battery. For this type of impact screwdriver, there has been used a switch as shown in FIGS. 5(A) and 5(B). A switch 100 shown in these figures include a switch body 101 and a operation member 103. The switch body 101 includes a cylindrical tubular case 101*c* and a rotary shaft 101*j*. A switch circuit (not shown) is disposed within the case 101*c*. The rotary shaft 101*j* is coaxially rotatably supported by the case 101*c* and extends in an axial direction from one end of the case 101*c*. The switch circuit is operated as the rotary shaft 101*j* rotates about its axis relative to the case 101*c*.

An operation member 103 surrounds the case 101*c* of the switch body 101 and is supported to be coaxial with the case 101*c*. One end of the operation member 103 is joined to the leading end portion of the rotary shaft 101*j* not to rotate relative thereto. Therefore, it is possible to rotate the rotary shaft 101*j* relative to the case 101*c* by operating the operation member 103. A pair of linier protrusions 103*t* for engaging fingers of a user are formed on the outer circumferential surface of the operation member 103 and extend in the axial direction.

As described above, one end in the axial direction of the rotary shaft 101*j* of the switch body 101 and one end in the axial direction of the operation member 103 are joined to each other. Therefore, when a pressing force is applied to a portion of the operation member 103 positioned between the central position and the other end during the operation of the operation member 103, a torsional force is applied to a joint portion between the operation member 103 and the rotary shaft 101*j* as indicated by arrows in FIG. 5(A), and therefore, it may be possible that the joint portion is loosened during the long time use.

This loosening of the joint portion may be prevented, for example, by providing a ring-shaped projection 105 that extends radially inwardly from the inner wall surface of the operation member 103 as shown in FIGS. 5(C) and 5(D). The inner circumferential edge of the projection 105 may contact the outer circumferential surface of the case 101*c* of the switch body 101, so that a middle portion with respect to the axial direction of the operation member 103 is supported by the projection 105. Therefore, it may be possible to prevent or inhibit application of the torsional force to the joint portion between the rotary shaft 101*j* and the operation member 103.

However, in the case of the arrangement shown in FIGS. 5(C) and 5(D), dust or cut powder may be clogged within a clearance between the inner circumferential edge of the projection 105 and the outer circumferential surface of the case 101*c* to prevent the operation member 103 (or the projection 105) from smoothly sliding relative to the case 101*c*.

Therefore, there is a need in the art for a switch that has a dust-proof performance and is improved in operability of an operation member

SUMMARY OF THE INVENTION

A switch device includes a switch body and an operation member. The switch body includes a case and a rotary shaft rotatably supported by the ease and extending from one end of the case in an axial direction. The operation member is joined to the rotary shaft, so that the rotary shaft rotates as the operation member is rotated. The case has a cylindrical outer surface and the operation member has a cylindrical inner surface disposed coaxial with the cylindrical outer surface of the case and having a diameter greater than a diameter of the cylindrical outer surface. A support member is disposed at one of the cylindrical outer surface of the case and the cylindrical inner surface of the operation member and has an edge portion extending linearly along a circumferential direction of the one of the cylindrical outer surface and the cylindrical inner surface, so that the edge portion can slidably contact the other of the cylindrical outer surface of the case and the cylindrical inner surface of the operation member.

DETAILED DESCRIPTION OF THE INVENTION

Figure 1:
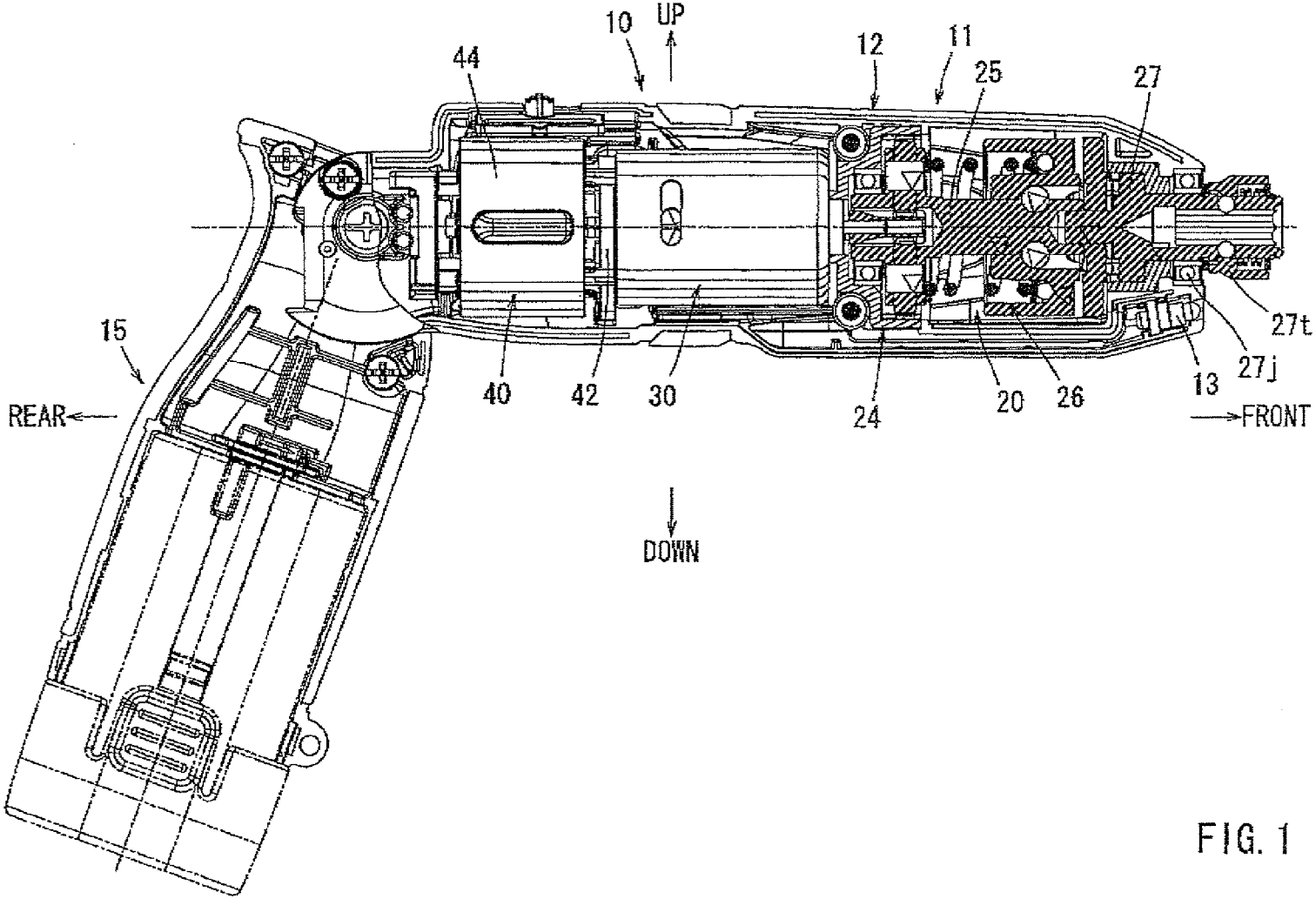
FIG. 1 is a side view, with some portions shown in vertical cross section, of a power tool incorporating a switch according to an example.

Each of the additional features and teachings disclosed above and below may be utilized separately or in conjunction with other features and teachings to provide improved switches and power tools incorporating such switches. Representative examples of the present invention, which examples utilize many of these additional features and teachings both separately and in conjunction with one another, will now be described in detail with reference to the attached drawings. This detailed description is merely, intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings.

In one example, a switch device includes a cylindrical tubular case receiving a switch circuit, a rotary shaft supported by the tubular case and rotatable relative to the tubular case, and a tubular operation member surrounding the tubular case and having the same axis as the tubular case. The operation member has a first end and a second end opposite to the first end in an axial direction. The first end of the operation member is joined to the rotary shaft, so that the operation member can rotate together with the rotary shaft about the axis. The switch circuit is operated as the operation member rotates with the rotary shaft relative to the case. A projection protrudes radially inwardly from an inner circumferential surface of the operation member and extending in a rotational direction of the operation member. The projection has a protruded end having a wedge-like cross section, so that the protruded end can contact an outer circumferential surface of the case in line contact relationship therewith.

Therefore, the operation member is supported by the projection from the radially inner side at a midway position in the axial direction in the state that the one end of the operation member is jointed to the rotary shaft extending in the axial direction from the case. Hence, even in the case that a pressing force is applied to the operation member at a region between the central position and the second end of the operation member during the operation of the operation member, no substantial torsional force may be applied to the joint portion between the rotary shaft and the operation member. As a result it is possible to prevent loosening of the joint portion during the long time use.

In addition, because the projection extends in the rotational direction of the operation member and its protruded end can contact the outer circumferential surface of the case in line contact relationship therewith, it is possible to prevent dust or cut powder from clogging between the protruded end and the outer circumferential surface of the case. Therefore, the operation member can smoothly slide on the case.

Each of opposite ends in the rotational direction of the operation member may have a wedge-like configuration. With this arrangement, dust or cut powder that may be deposited on the outer circumferential surface of the case can be scraped aside by the opposite ends of the operation member. Therefore, it is possible to further reliably prevent dust or out powder from clogging between the protruded end and the outer circumferential surface of the case.

The projection may be a plurality of projections spaced equally from each other in a circumferential direction of the operation member. With this arrangement, it is possible to support the operation member uniformly in the circumferential direction.

The projection may be disposed at a position proximal to the second end of the operation member. With this arrangement, it is possible to further reliably prevent the application of the torsion force to the joint portion between the rotary shaft and the operation member.

The switch device may further include a plurality of finger engaging protrusions formed on an outer circumferential surface of the operation member and extending linearly in the axial direction. The positions of the finger engaging protrusions are offset from the position of the projection in the circumferential direction of the operation member.

A power tool according to a representative example will now be described with reference to FIGS. 1 to 4(A) and 4(B). In this example, the power tool is configured as a pencil impact screwdriver having a rechargeable battery.

As shown in FIG. 1, a power tool 10 has a housing 11 including a tubular housing body 12 and a grip portion 15. The grip portion 15 is vertically pivotally joined to the base end portion of the housing body 12.

Within the housing body 12, a gear section 20, a motor 30 and a switch device 40 are coaxially disposed in series with each other in this order from the front side. The gear section 20 includes a planetary gear mechanism 24 for reducing the rotational speed of the motor 30, a spindle 25 rotatably driven by the motor 30 via the planetary gear mechanism 24, an impact force generating device 26 capable of converting the rotational force of the spindle 25 into a rotary impact force, and an anvil 27 capable of receiving the rotary impact force from the impact force generating device 26. The anvil 27 is supported by a bearing 27*j* and can rotate about its axis. A chuck 27*t* is mounted to the front end portion of the anvil 27, so that a tool bit, such as a driver bit or a socket bit (not shown) can be held by the chuck 27*t*.

The switch device 40 can be operated for changing the rotational direction of the motor 30 between the normal direction and the reverse direction, adjusting the rotational speed of the motor 30, and turning on and off an LED 13 (see FIG. 1) used for illumination. As shown in FIGS. 3(A) and 3(B), the switch device 40 includes a tubular switch body 42 and a cylindrical tubular operation member 44. The operation member 44 may be called "trigger." The cylindrical tubular operation member 44 coaxially surrounds the switch body 42. The operation member 44 has portions protruding from right and left openings (not shown) formed in the side wall of the housing body 12.

The switch body 42 includes a cylindrical tubular case 42*c* and a rotary shaft 42*j*. A switch circuit that will be explained later is disposed within the tubular case 42*c*. The rotary shaft 42*j* is supported by the case 42*c* so as to be rotatable about the same axis as the case 42*c*. The rotary shaft 42*j* extends rearwardly from the rear end (left end as viewed in FIG. 3(A)) from the case 42*c*. Rotating the rotary shaft 42*j* about its axis relative to the case 42*e* can operate the switch device 40.

Figure 2:
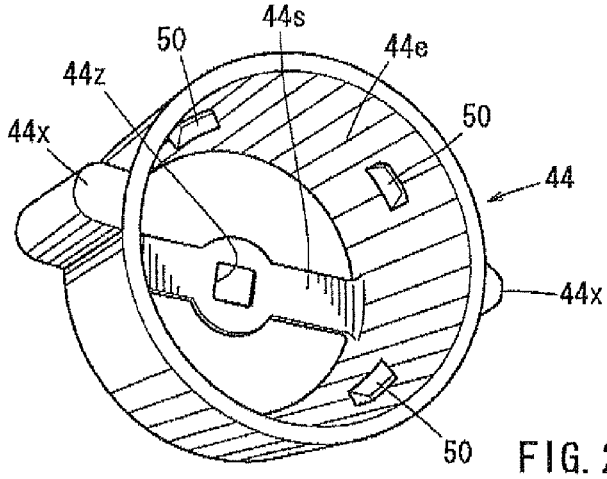
FIG. 2 is a perspective view of a operation member of the switch.
Figure 3:
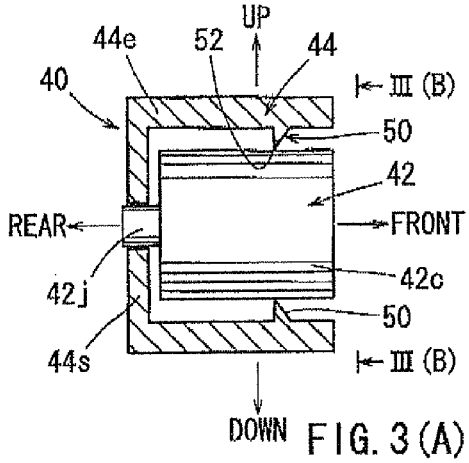
FIG. 3(A) is a vertical sectional view of the switch.
FIG. 3(B) is a front view of the switch as viewed in a direction indicated by arrows III(B) in FIG. 3(A)
FIG. 3(C) is a front view of a projection of the switch.
FIG. 3(D) is a cross sectional view take along line III(D)—, and—n enlarged view of a part of FIG. 1 and showing a positioning member and resilient members.
Figure 3:
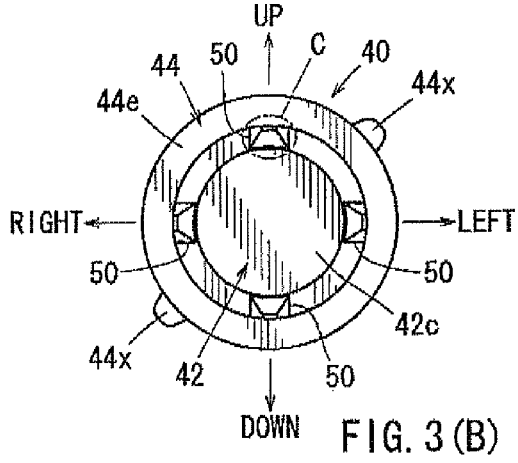
Figure 3:
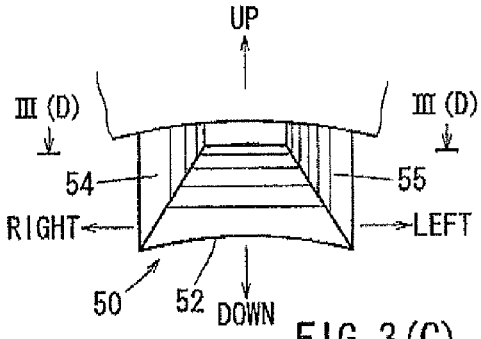
Figure 3:
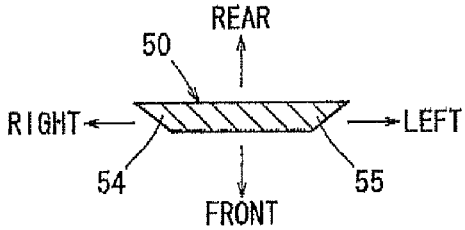

The operation member 44 can be operated by the user from the outer side of the housing body 12 for rotating the rotary shaft 42*j* relative to the case 420 of the switch body 42. As shown in FIG. 2, the operation member 44 includes a cylindrical tubular portion 44*e* and a band-like plate portion 44*s*. The plate portion 44*s* is connected to the rear end of the tubular portion 44*e* and extends across the rear opening of the tubular portion 44*e*. A square opening 44*z* is formed in the central portion of the plate portion 44*s*, through which the rotational axis of the operation member 44 extends. The square opening 44*z* is sized to be capable of fitting with the leading end portion of the rotary shaft 42*j* of the switch body 42. With the leading end portion of the rotary shaft 425 fitted into the square opening 44*z*, the leading end portion is joined to the plate portion 44*s* of the operation member 44 not to rotate relative thereto, for example, by crimping the central portion of the plate portion 44*s*. Therefore, the operation member 44 is supported by the rotary shaft 42*j* so as to have the same axis as the rotary shaft 42*j* and the case 42*c* and so as to be rotatable together with the rotary shaft 42*j*.

A plurality of support members 50 (four in this example) are formed on a cylindrical inner circumferential surface of the tubular portion 44*e* of the operation member 44 at a positions forwardly of the central position with respect to the axial direction of the inner circumferential surface. The support members 50 are configured as projections that are spaced equally from each other in the circumferential direction and serve to support the front portion of the tubular portion 44*e* from the radially inner side. As shown in FIGS. 3(B) and 3(C), each of the support members 50 is configured to have a substantially rectangular plate positioned to extend along the rotational direction of the operation member 44. In addition, as shown in FIG. 3(A), each of the operation members 50 is formed to have a wedge-like configuration in cross section taken along a plane including the rotational axis of the operation member 44. In other words, each of the operation members 50 has a thickness in the axial direction, which gradually decreases toward a cylindrical outer circumferential surface of the case 42*c*. Therefore, a protruded edge 52 protruding radially inwardly of each support member 50 is in line contact with the outer circumferential surface of the case 42*c*. Hence, dust or cut powder can be prevented from being clogged between the protruded edge 52 and the outer circumferential surface of the case 42*e*. In addition, as shown in FIGS. 3(C) and 3(D), each of right and left end portions 54 and 55 in the rotational direction of the operation member 44 of each of the support members 50 is formed to have a wedge-like-configuration, so that the thickness of the end portion 54 decreases in the right direction and the thickness of the end portion 55 decreases in the left direction. Therefore, dust or cut powder that may be deposited on the outer circumferential surface of the case 42*c* can be scraped aside by the end portions 54 and 55.

On a cylindrical outer circumferential surface of the operation member 44, a pair of finger engaging projections 44*x* are formed at positions opposite to each other with respect to the central axis of the operation member 44 and extend in the axial direction of the operation member 44. The corner portions opposed to each other in the circumferential direction of each of the engaging projections 44*x* are rounded to smoothly continue with surfaces (i.e., a radially outer surface and side surfaces opposed to each other in the circumferential direction) of the corresponding projection 44*x*. In this example, with respect to the position in the circumferential direction of the operation member 44, each of the finger engaging projections 44*x* is positioned between two of the support members 50 and is offset therefrom by an angle of about 45°.

Therefore, in order to operate the switch device 40, the user may engage his or her fingers with, the ginger engaging projections 44*x* and rotate the operation member 44, so that the rotary shaft 42*j* of the switch body 42 rotates about its axis.

Figure 4A:
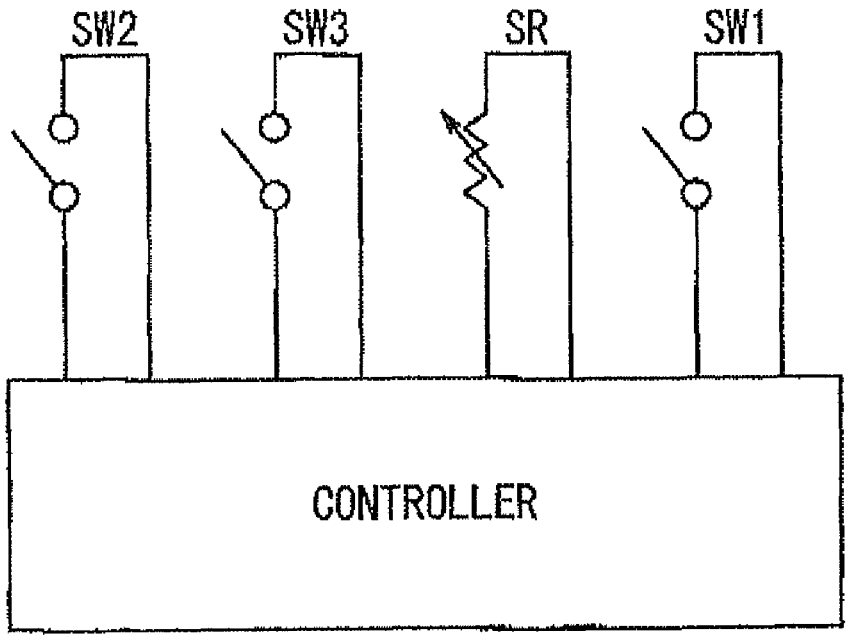
FIG. 4(A) is a schematic circuit diagram of the switch.

The switch circuit of the switch device 40 is disposed within the case 42*c* and will be described with reference to FIGS. 4(A) and 4(B). Referring to FIG. 4(A), the switch circuit includes a first switch SW1 for tuning on and off the LED 13, a second switch SW2 for rotating the motor 30 in the normal direction, a third switch SW3 for rotating the motor 30 in the reverse direction, a variable resistor SR for adjusting the rotational speed of the motor 30, and a controller for controlling the motor 30. Output signals from the first to third switches SW1 to SW3 and an output signal from the variable resistor SR are inputted into the controller that controls the motor 30.

Figure 4B:
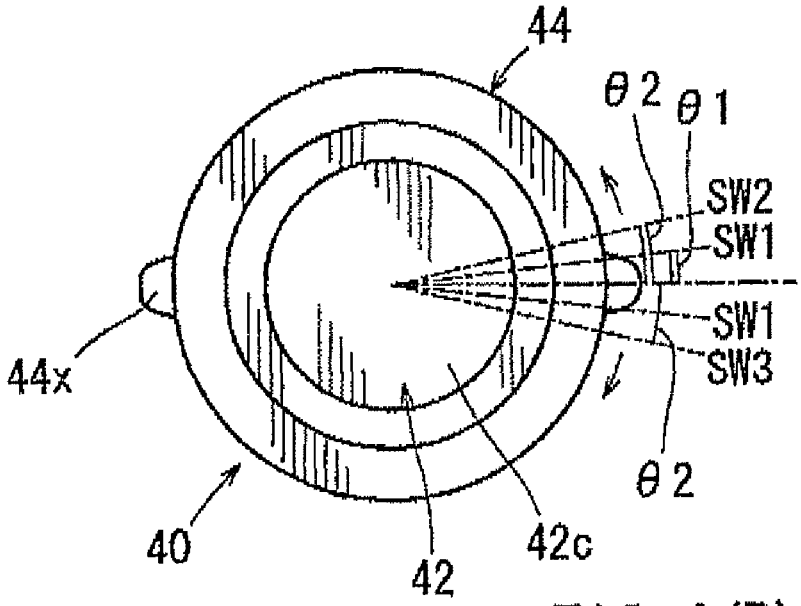
FIG. 4(B) is a schematic view showing the operation of the switch.
Figure 5A:
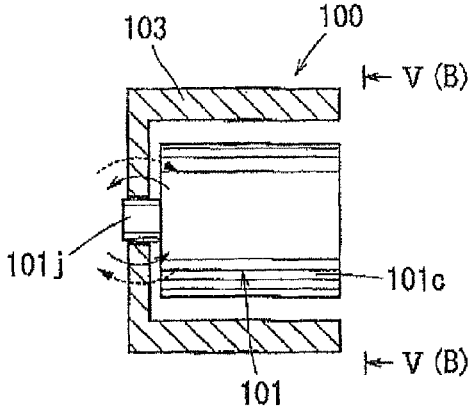
FIG. 5(A) PRIOR ART
FIG. 5(A) is a vertical sectional view of a know switch.
Figure 5B:
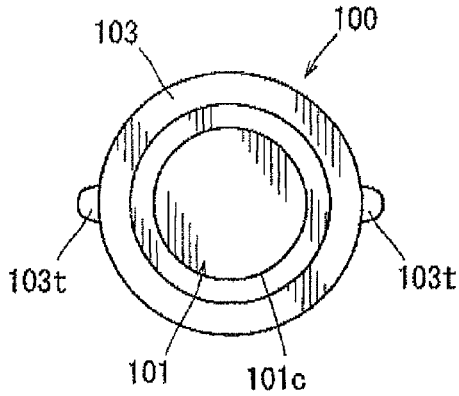
FIG. 5(B) PRIOR ART
FIG. 5(B) is a view of the known switch as viewed in a direction indicated by arrows V(B) in FIG. 5(A)
Figure 5C:
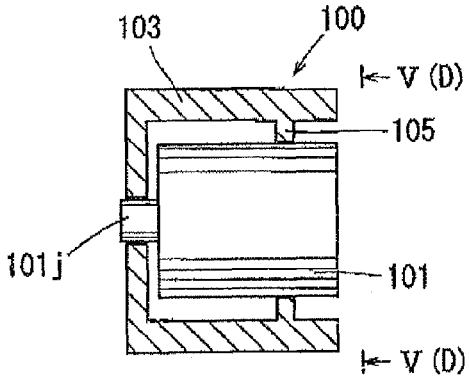
FIG. 5(C) PRIOR ART
FIG. 5(C) is a vertical sectional view of another known switch.
Figure 5D:
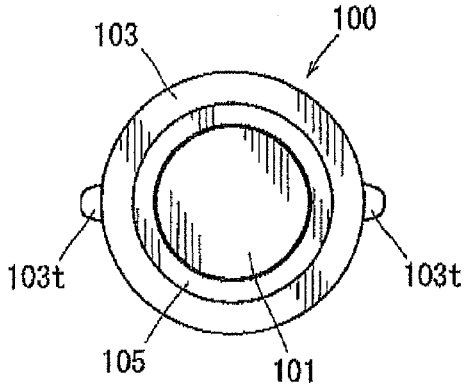
FIG. 5(D) PRIOR ART
FIG. 5(D) is a view of the known switch as viewed in a direction indicated by arrows V(D) in FIG. 5(A).

As shown in FIG. 4(B), the first switch SW1 turns from off to on when the operation member 44 has been rotated in a normal direction or a reverse direction by an angle of θ1 from a reference position (original position). When the operation member 44 has been rotated by the angle of θ1, the operation member 44 is held in position by a force of a spring (not shown) and an engaging sound (click sound) is produced. The operation member 44 can be rotated further from the angle θ1 position by applying a force that is greater than the spring force.

The second switch SW2 and the third switch SW3 turn from off to on when the operation member 44 has been rotated in the normal direction and the reverse direction, respectively, by an angle of θ2 from the reference position. Here, the angle of θ2 is set to be larger than the angle of θ1. Thus, there exists the relationship "θ1<θ2". Also, when the operation member 44 has been rotated by the angle of θ2, the operation member 44 is held in position by a force of a spring (not shown) and an engaging sound (click sound) is produced. The operation member 44 can be rotated further from the angle θ2 position by applying a force that is greater than the spring force.

The resistance value of the variable resistor SR changes as the operation member 44 is rotated further to increase the rotational angle from the angle θ2 position in the normal direction or the reverse direction.

With the above arrangement, it is possible to turn on the LED 13 without causing the motor 30 to start rotation when the user rotates the operation member 44 by the angle of θ1 in the normal direction from the reference position. When the user rotates the operation member 44 further from the angle θ1 position in the normal direction to the angle θ2 position, the motor 30 starts to rotate. As the user further rotates the operation member 44 from the angle θ2 position, the rotational speed of the motor 30 increases in response to increase of the rotational angle of the operation member 44. The motor 30 is stopped and the LED 13 is turned off when the user returns the operation member 44 to the reference position.

Similarly, it is possible to turn on the LED 13 without causing the motor 30 to start rotation when the user rotates the operation member 44 by the angle of θ1 in the reverse direction from the reference position. When the user rotates the operation member 44 further from the angle θ1 position in the reverse direction to the angle θ2 position, the motor 30 starts to rotate in the reverse direction. As the user further rotates the operation member 44 from the angle θ2 position, the rotational speed of the motor 30 increases in response to increase of the rotational angle of the operation member 44.

As described above, according to the switch device 40 of above example, one end of the operation member 44 in the axial direction is joined to the rotary shaft 42*j* that extends axially from the case 42*c*. Further, the projections or the support members 50 are formed on the inner circumferential surface of the operation member 44 and protrude radially inwardly therefrom. The protruded end 52 of each of the support members 50 is in line contact with the outer circumferential surface of the case 42*c*. Thus, in the state that the axially one side of the operation member 44 is joined to the rotary shaft 42*j* extending axially from the case 42*c*, the intermediate portion with respect to the axial direction of the operation member 44 is supported by the support members 50 from its radially inner side. Therefore, even in the case that a pressing force is applied to a portion of the operation member 44 positioned between the central position and the other end position with respect to the axial direction, no substantial torsional force may be applied to the joint portion between the rotary shaft 42*j* and the operation member 44. Hence, the joint portion is prevented from being loosened during the long time user.

Further, the support members 50 extend along the inner circumferential wall of the operation member 44 in the rotational direction, and the protruded ends 52 of the support members 50 are in line contact with the outer circumferential surface of the case 42*c*. Therefore, dust or cut powder may not be clogged between the protruded ends 52 of the support members 50 and the outer circumferential surface of the case 42*c*. As a result, it is possible to prevent improper sliding contact of the operation member 44 with the case 42*e*.

Furthermore, each of right and left end portions 54 and 55 (in the rotational direction of the operation member 44) of each of the projections 50 is formed to have a wedge-like-configuration. Therefore, dust or cut powder that may be deposited on the outer circumferential surface of the case 42*c* of the switch body 42 can be scraped aside by the end portion 54 and 55 as the operation member 44 rotates relative to the case 42*c*. Therefore, also in this respect, it is possible to prevent dust or cut powder from being clogged between the protruded ends 52 of the support members 50 and the outer circumferential surface of the case 42*c*.

Furthermore, because the support members 50 are provided in a plural number and are spaced equally from each other in the circumferential direction, it is possible to support the operation member 44 by the support members 50 substantially uniformly in the circumferential direction.

Furthermore, the support members 50 are disposed proximal to the front end of the operation member 44, the rear end of which is joined to the rotary shaft 42*j*. Therefore, it is possible to further reliably prevent the application of the torsional force to the joint portion between the rotary shaft 42*j* of the switch body 42 and the operation member 44.

The above example may be modified in various ways. For example, although a plurality of support members 50 are formed on the inner circumferential surface of the operation member 44, it may be possible to configure a single ring-shaped projection or a single C-shaped projection by joining the support members 50 to each other. In addition, in the case that a plurality of support members 50 are provided, the number of the support members 50 may not be limited to four but may be any suitable number.

Further, although each of the support members 50 has a substantially rectangular plate-like configuration, it may have any other suitable configuration, such as a trapezoidal plate-like configuration.

Furthermore, although the support members 50 are formed integrally with the operation member 44, they may be formed integrally with the ease 42*c* or may be separate members that are fixedly mounted to the operation member 44 or the case 42*c* by using a suitable technique, such as adhesion or welding.

Further, although the switch device 40 of the above example is applied to a pencil impact screwdriver having a rechargeable battery, the switch device 40 may be applied to any other power tools or any other machines and apparatus, as long as they have a motor and a switch for controlling the motor.

What is claimed is:

1. A switch device comprising:

a cylindrical tubular case receiving a switch circuit;

a rotary shaft supported by the tubular case and rotatable relative to the tubular case; and a tubular operation member surrounding the tubular case and having the same axis as the tubular case;

wherein the operation member has a first end and a second end opposite to the first end in an axial direction;

wherein the first end of the operation member is joined to the rotary shaft, so that the operation member can rotate together with the rotary shaft about the axis;

wherein the switch circuit is operated as the operation member rotates with the rotary shaft relative to the case; and a projection protruding radially inwardly from an inner circumferential surface of the operation member and extending in a rotational direction of the operation member; and wherein the projection has a protruded end having a wedge-like cross section, so that the protruded end can contact an outer circumferential surface of the case in line contact relationship therewith.

2. The switch device as in claim 1, wherein the projection has opposite ends in the rotational direction of the operation member, and each of the opposite ends has a wedge-like configuration.

3. The switch device as in claim 1, wherein the projection comprises a plurality of projections spaced equally from each other in a circumferential direction of the operation member.

4. The switch device as in claim 1, wherein the projection is disposed at a position proximal to the second end of the operation member.

5. The switch device as in claim 1, further comprising a plurality of finger engaging protrusions formed on an outer circumferential surface of the operation member and extending linearly in the axial direction, wherein positions of the finger engaging protrusions are offset from the position of the projection in the circumferential direction of the operation member.

6. A power tool comprising the switch device as defined in claim 1 and further comprising a motor controlled by the switch device.

7. A switch device comprising:

a switch body including a case and a rotary shaft rotatably supported by the case and extending from one end of the case in an axial direction, an operation member joined to the rotary shaft, so that the rotary shaft rotates as the operation member is rotated; wherein:

the case has a cylindrical outer surface;

the operation member has a cylindrical inner surface disposed coaxial with the cylindrical outer surface of the case; and a support member disposed at one of the cylindrical outer surface of the case and the cylindrical inner surface of the operation member and having an edge portion extending linearly along a circumferential direction of the one of the cylindrical outer surface and the cylindrical inner surface, so that the edge portion can slidably contact the other of the cylindrical outer surface of the case and the cylindrical inner surface of the operation member.

8. The switch device as in claim 7, wherein the support member is formed integrally with the one of the cylindrical outer surface and the cylindrical inner surface.

9. The switch device as in claim 7, wherein the edge portion has a wedge-like configuration in cross section.

10. The switch device as in claim 8, wherein the support member is a projection protruding radially inwardly from the cylindrical inner surface of the operation member and extending in a rotational direction of the operation member.

11. The switch device as in claim 10, wherein the projection has opposite ends in the rotational direction of the operation member, and each of the opposite ends has a wedge-like configuration.

12. The switch device as in claim 10, wherein the projection comprises a plurality of projections spaced equally from each other in the circumferential direction of the operation member.

13. The switch device as in claim 10, further comprising a plurality of finger engaging protrusions formed on an outer circumferential surface of the operation member and extending linearly in the axial direction, wherein positions of the finger engaging protrusions are offset from the position of the projection in the circumferential direction of the operation member.

14. A power tool comprising the switch device as defined in claim 7 and further comprising a motor controlled by the switch device.

* * * * *